United States Patent [19]

Drain

[11] 4,337,033

[45] Jun. 29, 1982

[54] APPARATUS FOR CURING MASONRY UNITS

[76] Inventor: Bob R. Drain, 3660 N. 3rd St., Phoenix, Ariz. 85012

[21] Appl. No.: 222,055

[22] Filed: Jan. 2, 1981

Related U.S. Application Data

[62] Division of Ser. No. 888,630, Mar. 21, 1978, Pat. No. 4,244,904.

[51] Int. Cl.[3] ..... F27B 15/00; F27B 5/16

[52] U.S. Cl. ..... 432/197; 264/82; 432/200

[58] Field of Search ..... 432/197, 200; 264/82

[56] References Cited

U.S. PATENT DOCUMENTS 1,155,145 9/1915 Gehnrich ..... 432/200
3,671,165 6/1972 Schwellenbach ..... 425/445
4,099,337 7/1978 Wauhop, Jr. ..... 264/82
4,185,396 1/1980 Haisser ..... 432/197

*Primary Examiner*—John J. Camby

[57] ABSTRACT

Masonry units are cured in a kiln having a gaseous atmosphere including water vapor. A portion of this atmosphere is withdrawn and mixed with a flowing stream of heated water. This mixture is injected into a body of water disposed within the kiln at a plurality of spaced apart locations and beneath the surface of the body of water whereupon the gaseous atmosphere is heated and rises to and escapes from the surface of the body of water in the form of bubbles. In a preferred embodiment, the apparatus for withdrawal of atmosphere from the kiln includes an aspirator incorporated in a conduit which also circulates heated water to the body of water within the kiln.

5 Claims, 1 Drawing Figure

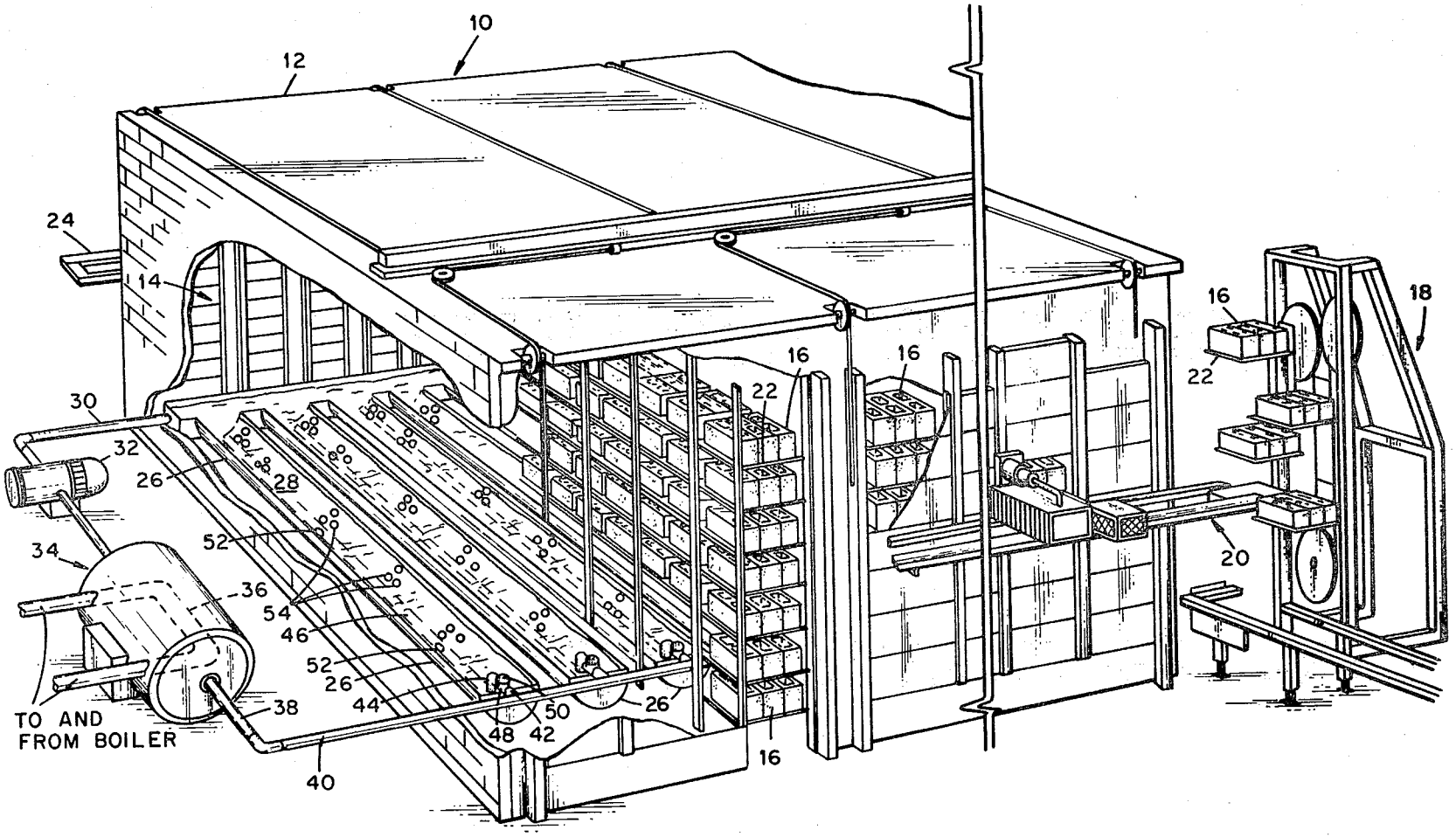
10
12
14
16
18
20
22
24
26
28
30
32
34
36
38
40
42
44
46
48
50
52
54
TO AND FROM BOILER

APPARATUS FOR CURING MASONRY UNITS

This is a division of application Ser. No. 888,630, filed Mar. 21, 1978, now U.S. Pat. No. 4,244,904.

This invention relates to methods and apparatus for the curing of masonry units, and particularly to kilns for curing masonry block and/or brick.

In the manufacture of a masonry block, brick or similar unit as employed in the construction industry, it is common practice to mold the block from a mixture of cement and other materials such as sand and/or aggregate. This molded unit requires a period of curing for the cement to reach its anticipated strength characteristics. Such curing of the "green" block can be carried out under naturally occurring conditions but understandably is subject to the vagaries of weather and requires both long periods of time and large storage areas. It has been the general practice in the industry heretofore to shorten the curing time for green block by subjecting the block to elevated temperatures in a kiln. Commonly such kilns are heated by means of steam introduced into the kiln which defines a closed chamber containing the block. It has been found that subjecting the green block to steam results in crazing or cracking of the block, apparently due to case hardening and a thermal shock to the block with consequential loss of strength property. These problems arise in part by reason of the nonuniform curing of the block which occurs in steam kilns. Extended, i.e. slow, buildup of heat in a steam kiln, termed "preset", has been employed to reduce the likelihood of block damage, but such requires a batch-type operation that is expensive and wasteful of energy.

More recently, it has been proposed that the block be cured in a kiln having a heated atmosphere including a water vapor, as opposed to steam. This water vapor atmosphere within the kiln has been developed heretofore by providing a body of water adjacent the floor of the kiln in position to release water vapor into the kiln atmosphere. In one embodiment, this body of water is agitated as by spraying heated water onto the surface of the body of water to enhance the release of water vapor into the kiln atmosphere. These and other prior art devices, while accomplishing, at least in part, the desired result, have encountered difficulties, partly by reason of mechanical failure of the apparatus employed to introduce the water vapor into the kiln atmosphere. For example, the spray nozzles employed heretofore are subject to plugging and/or corrosion with resultant malfunction. In addition, problems have arisen heretofore in acquiring and/or maintaining the desired humidity within the kiln atmosphere and for adjusting the same in a manner that will provide for the desired rate of curing of the block.

The present invention, in its preferred embodiment, is employed in combination with a kiln of the type disclosed and claimed in U.S. Pat. Nos. 3,671,165 and 3,492,704, which patents are incorporated herein in their entirety by reference. Further, reference is made of U.S. Pat. No. 4,016,986, disclosing and claiming improved apparatus for minimizing loss of kiln atmosphere during loading and unloading of block from the kiln, such patent also being incorporated herein in its entirety by reference.

In accordance with the present invention, there is provided an improved method for establishing and maintaining a desired curing atmosphere in a kiln, which kiln defines a chamber for receiving block for curing and having a gaseous atmosphere that includes water vapor. In accordance with the present disclosure there is withdrawn from the kiln atmosphere a portion of such atmosphere. This withdrawn portion of the atmosphere is mixed with a flowing stream of heated water, with this mixture being injected into a body of water disposed within the kiln adjacent the floor of the kiln. The injection of the mixture into the body of water takes place at a plurality of spaced apart locations which are beneath the surface of the body of water such that the gaseous portion of the mixture enters the body of water in the form of bubbles which rise to, and escape from, the surface of the body of water to more effectively convey heated water vapor to the kiln atmosphere. In a preferred form of the apparatus employed, at a location within the kiln, there is provided a conduit for circulating heated water to the body of water adjacent the floor of the kiln. In this conduit, there is interposed an aspirator having an inlet exposed to the kiln atmosphere such that as the heated water is circulated to the body of water within the kiln, a portion of the kiln atmosphere is aspirated into the flowing stream of heated water and thereafter injected with the heated water into the body of water through a plurality of openings through the wall of a distribution conduit. These openings are spaced apart from one another and are located within the body of water beneath the surface thereof.

Among the advantages achieved by the present method and apparatus, is the minimization of maintenance of the system. Notably, there are no moving parts in the disclosed apparatus disposed within the kiln and which would be subjected to the substantially corrosive atmosphere within the kiln.

It is therefore an object of this invention to provide an improved method for the curing of masonry units. It is another object of this invention to provide an improved method for establishing and maintaining a water vapor atmosphere within a kiln for masonry units. It is another object of this invention to provide an improved apparatus for establishing and maintaining a water vapor atmosphere within a kiln for curing masonry units.

Other objects and advantages of the invention will be recognized from the following description, including the claims and drawings in which:

The FIGURE is a representation of a kiln embodying various features of the invention.

Referring now to the FIGURE, there is depicted a kiln indicated generally by the numeral 10 which includes a housing 12 defining an interior chamber 14. "Green" molded masonry units, specifically block 16, are received from a molding station (not shown), and transferred by means of an elevator mechanism 18 to a conveyor 20. In a manner known heretofore, for handling purposes, a plurality of block 16 are disposed on individual metal pallets 22. Each pallet containing its burden of block is inserted into the kiln at an appropriate location within the kiln as is fully described in U.S. Pat. Nos. 3,671,165 and 3,492,704. Simultaneously upon insertion of a batch of green blocks at one end of a row of block within the kiln, a like quantity of block is ejected from the opposite end of the row onto a conveyor 24 for transfer to storage.

Within the kiln, the block are tiered. Beneath each tier, in the depicted embodiment, there is provided a tray 26 adapted to contain a body of water 28.

Whereas individual trays are depicted beneath each tier within the kiln shown in the FIGURE, it will be recognized that a tray could be provided beneath several adjacent tiers and/or a single tray could be provided to extend beneath all of the tiers in the kiln.

As depicted in the FIGURE, the ends 29 of the several trays are in fluid communication such that the water within the trays are withdrawn from the kiln through a conduit 30 as by a pump 32 and transferred through a heating station indicated generally by the numeral 34. Within this heating station, there is provided a heat exchanger 36 which is connected to a boiler (not shown) in a conventional manner. As the water passes through the heating station, it is subjected to the heat exchanger 36 such that heat is transferred to the water to raise its temperature. The heated water is conveyed from the heating station 34 as by conduit 38 to a header 40 that extends along one side of the kiln housing 12. At spaced apart locations along the length of the header 40, there is connected to the header a conduit 42 (typical) in fluid communication with the header. This conduit extends from the header and is exposed to the kiln atmosphere with its end 44 being further connected to a distribution conduit 46 disposed within and beneath the surface of the body of water 28 in the tray 26.

In that portion of the conduit 42 exposed to the kiln atmosphere, there is provided an aspirator 48 having its gaseous inlet 50 exposed to the kiln atmosphere. By reason of this construction of the apparatus, as heated water is caused to flow from the header 40 through the conduit section 42, to the distribution conduit 46, the kiln atmosphere, comprising generally air and water vapor, is drawn through the aspirator and mixed with the flowing heated water. This mixture is conveyed to the distribution conduit 46 which includes a plurality of openings 52 spaced apart along the length thereof. The mixture of kiln atmosphere and heated water is injected from these openings 52 into the body of water 28 at such spaced apart locations and beneath the surface of the body of water. In this manner, the gaseous portion of the kiln atmosphere that is withdrawn and mixed with the heated water is introduced into the body of water in the form of bubbles 54 which rise to the surface of the body of water. These bubbles burst eventually and discharge the gaseous matter therein directly into the kiln atmosphere. It will be recognized that during the time that the kiln atmosphere is subjected to the heated flowing water following aspiration of the kiln atmosphere into the conduit 42 and during the movement of the heated water and the kiln atmosphere along the distribution conduit 46, plus the time required for the bubbles to rise to the surface of the body of water, the gaseous atmosphere of the kiln so withdrawn and conveyed is heated and absorbs substantial water vapor. When this gaseous matter escapes into the kiln atmosphere, it carries with it this heated water vapor. By reason of the heated gaseous material rising in a natural manner, the heated air with the water vapor is caused to circulate about the several block in the tiers above the tray to provide the desired high humidity heated gaseous atmosphere for controlled curing of the block.

As the gaseous matter in the kiln atmosphere loses its heat to the block in the curing process, this gaseous matter, principally air, is conveyed by convection currents back toward the floor of the kiln where it is again collected in part by the aspirator 48 for recirculating. In this manner, in accordance with the present invention, there is developed a closed-loop type circulation of the kiln atmosphere with the simultaneous introduction of substantial quantities of water vapor to the kiln atmosphere. Notably, there is no substantial reduction in the overall temperature within the kiln by reason of the present recirculation process so that there is maintained within the kiln an atmosphere which is relatively uniform as regard to both its temperature and its humidity.

When employed in combination with the kiln described in U.S. Pat. No. 3,671,165 or similar kiln and including the closure means disclosed in U.S. Pat. No. 4,016,986, the present process provides for the continuous introduction of green block at one end of the kiln and simultaneous continuous removal of cured blocks from the opposite end of the kiln, all without substantial loss of overall kiln atmosphere or substantial reduction in the uniformity of the kiln atmosphere as regards its temperature or humidity.

Referring to the FIGURE, as compared with the steam heated kiln process employed in the prior art, the present process provides for the introduction of green block into the kiln at a time when the kiln temperature is established at its optimum temperature and humidity for curing without deleterious effects upon the block, and in the present process, the curing mechanism commences immediately upon introduction of the block to the kiln and continues until the block is removed from the kiln.

In one specific embodiment of the present invention, there is provided a kiln defining a chamber approximately 36 feet wide by 45 feet deep by 15 feet high. Within this kiln there are disposed twelve tiers of block. Beneath each tier of block there is provided an elongated tray having a semicircular cross-section. Each tray is 21 inches in diameter and approximately 36 feet long. The tray is filled with water to a maximum depth of about 9 to 10 inches. Water is withdrawn from the several trays at a rate of approximately 200 gallons per minute and recirculated through the heating station 34, thence through the header 40, thence through the several aspirators to the distribution conduits within the trays.

In this embodiment, approximately 400 cubic per minute of air is withdrawn from the kiln through the twelve aspirators. Approximately 15 to 20 gallons of water per minute is moved across the aspirator, which in this instance is a Bell and Gossett venturi having a one inch internal diameter water inlet, a one inch internal diameter water outlet and a three-quarter inch internal diameter throat inlet through which air is inducted into the flowing stream of water. A one inch internal diameter tubing approximately thirty-five feet in length, and having forty $\frac{1}{8}$ inch diameter holes drilled through the walls thereof at generally equally spaced apart locations along the length of the tubing serves as the distribution conduit 46. In a preferred embodiment, the holes through the tubing wall are spaced closer to one another near the opposite ends of the tubing, that is, adjacent the side walls of the kiln where loading and unloading takes place to accommodate the heat losses that occur through the end walls of the kiln in the course of loading and unloading blocks to and from the kiln. The mixture of kiln atmosphere and heated water injected into the water in the tray roiled the water and produced numerous bubbles that rose through the water and escaped from the surface thereof in a relatively vigorous type activity.

In this specific embodiment, the water temperature leaving the kiln is approximately 160° F., and the temperature of the water entering the kiln is between 170° and 175° F. Employing the parameters referred to in this embodiment, the kiln atmosphere is maintained at approximately 140° F. and substantially 100 percent relative humidity.

The temperature and humidity of the kiln atmosphere were noted to remain substantially uniform. The block were inserted into the kiln and withdrawn from the kiln in a continuous type operation. The strength properties of the block cured employing the present invention exhibited good strength characteristics and no evidence of crazing or cracking. The curing time for a block employing the present invention was about ten hours, or about one-half the curing time required in a batch-type steam-heated curing process.

While a preferred embodiment has been shown and described, it will be understood that there is no intent to limit the invention by such disclosure, but rather, it is intended to cover all modifications and alternate constructions falling within the spirit and scope of the invention as defined in the appended claims.

What is claimed is:

1. In a system for curing masonry units employing heated air including housing means defining a substantially closed chamber, means for introducing uncured masonry units into said chamber and means for removing substantially cured masonry units from said chamber, the improvement comprising means introducing heated water into said chamber, means collecting a portion of said chamber atmosphere and aspirating said collected portion with said water being introduced to said chamber, means within said chamber defining a vessel for a quantity of said heated water, means injecting said air and heated water mixture into said quantity of water in said vessel at spaced apart locations beneath the surface of said quantity of water.

2. The improvement of claim 1 wherein said means introducing said heated water into said chamber comprises conduit means, and said aspirator means is interposed in said conduit means at a location within said chamber.

3. In a system for curing masonry units employing a kiln defining a substantially closed chamber receiving said masonry units provided with a heated atmosphere including water vapor, said kiln including means for loading green masonry units in said kiln and removing cured masonry units from said kiln on a continuous basis without substantial loss of kiln atmosphere to the exterior thereof during such loading and unloading, vessel means disposed adjacent the floor of said kiln within said chamber and beneath said masonry units and containing a quantity of water, means for withdrawing said water from said vessel means, means heating said withdrawn water, and means returning said water to said vessel, the improvement comprising means collecting and aspirating a portion of said kiln atmosphere with said water returned to said vessel.

4. The improvement of claim 3 including distribution means disposed within said vessel means and beneath the surface of said quantity of water, said distribution means receiving said mixture of kiln atmosphere and heated water and introducing the same into said quantity of water at spaced apart locations beneath the surface of said quantity of water.

5. The improvement of claim 3 wherein said means returning said water to said vessel comprises conduit means and said aspirator means is interposed in said conduit means at a location within said chamber.

* * * * *